US005092476A

United States Patent [19]

Yasuda et al.

[11] Patent Number: 5,092,476

[45] Date of Patent: Mar. 3, 1992

[54] SYNTHETIC RESIN VESSEL HAVING HANDLE

[75] Inventors: Yosuke Yasuda, Tokyo; Masaki Miura, Kawasaki; Yoshimichi Ohkubo; Shinichi Miyazaki, both of Tokyo, all of Japan

[73] Assignee: Toyo Seikan Kaisha, Ltd., Tokyo, Japan

[21] Appl. No.: 654,123

[22] Filed: Feb. 12, 1991

[30] Foreign Application Priority Data

Feb. 14, 1990 [JP] Japan ..... 2-12788[U]

[51] Int. Cl.[5] ..... B65D 23/10; B65D 25/28

[52] U.S. Cl. ..... 215/100 A; 220/94 R; 220/94 A

[58] Field of Search ..... 215/1 C, 100 A; 220/94 R, 94 A

[56] References Cited

U.S. PATENT DOCUMENTS

| | | | |
|---|---|---|---|
| 3,140,329 | 7/1964 | Nutting | 215/100 A |
| 4,257,525 | 3/1981 | Thompson | 215/100 A |
| 4,280,859 | 7/1981 | Thompson | 215/1 C X |
| 4,363,415 | 12/1982 | Rainville | 215/100 A |
| 4,727,997 | 3/1988 | Nakamura et al. | 220/94 A X |
| 4,915,241 | 4/1990 | Morimura et al. | 220/94 A X |
| 4,964,522 | 10/1990 | Ometsu et al. | 220/94 A X |

*Primary Examiner*—Sue A. Weaver

*Attorney, Agent, or Firm*—Sughrue, Mion, Zinn, Macpeak & Seas

[57] ABSTRACT

A synthetic resin vessel having a handle, which comprises a vessel proper comprising a neck, a barrel and a closed bottom, which are integrally prepared by blow-forming or draw-blow-forming of a synthetic resin, a recess formed at a part of the barrel so that a deepest part of the recess has a diameter substantially equal or slightly larger than the diameter of the neck, a projection formed substantially at the center of the recess so that the section of the projection is non-circular, a circumferential concave groove formed around the projection, and a pair of short concave grooves extending from the top end and bottom end of the circumferential concave groove along the concave portion upwardly and downwardly, respectively, and a handle comprising an endless holding portion and an endless attachment portion, which are integrally prepared by injection molding of a synthetic resin, the handle being fixed by inserting the attachment portion into the circumferential concave groove and inserting the central part of the holding portion on the side end of the attachment portion into the short concave grooves.

4 Claims, 10 Drawing Sheets

SYNTHETIC RESIN VESSEL HAVING HANDLE

BACKGROUND OF THE INVENTION

1. Field of the Invention

The present invention relates to a synthetic resin vessel having a handle. More particularly, the present invention relates to a synthetic resin vessel having a handle, in which the handle is secured assuredly and tightly to the vessel proper, and which can be easily held even in the state where it is fully filled and which can be compactly contained in a case.

2. Description of the Related Art

A plastic hollow vessel it light weight and has an excellent impact resistance. Accordingly, this vessel is widely used as a container for various liquids. Especially, a hollow vessel obtained by blow-draw-forming of polyethylene terephthalate (hereinafter referred to as "PET") has a high transparency, a good gas-barrier property, a light weight, an excellent impact resistance and an appropriate rigidity in combination, and this vessel is widely used as a packaging container for storing liquids therein.

In case of a draw-blow formed vessel of this type having a large size, in order to facilitate handling, it is desired to attach a handle to the vessel proper. From the principle of the blow-draw-forming process, it is difficult to form a handle integrally with the vessel by draw-blow-forming. Therefore, several proposals have been made on the methods of attaching a handle to a draw-blow-formed vessel.

For example, there have been proposed a process in which a handle is formed in advance, the handle is placed in a blow mold, and a vessel-forming preform is draw-blown to prepare a draw-blown formed vessel having a handle integrated therewith (see Japanese Unexamined Patent Publication No. 56-64948, Japanese Unexamined Patent Publication No. 56-64949 and Japanese Unexamined Patent Publication No. 56-74438), and a process in which a vessel having a handle is prepared by arranging, in a rotary, a station for forming a vessel preform by an injection unit, a station for draw-blow-forming the preform, a station for arranging an injection mold around the formed vessel, applying a pressure to the interior of the vessel and injection-forming a handle by another injection unit and a station for withdrawing the formed vessel having a handle (see Japanese Unexamined Patent Publication No. 62-182044).

Where a handle is formed on a vessel, ordinarily a method is used in which a plurality of circumferential grooves are formed around the circumference of the vessel, and a handle is constructed by a plurality of band portions surrounding the circumferential grooves closely thereto and a handle portion formed integrally with the band portions. However, the presence of such band portions is not preferable in view of the appearance characteristics of the vessel. Moreover, molding defects such as burrs and weld marks are readily formed when the band portions are formed around the vessel by injection molding. This method is still insufficient in the effect of fixing the handle to the vessel assuredly and tightly.

SUMMARY OF THE INVENTION

It is therefore a primary object of the present invention to provide a synthetic resin vessel having a handle, in which the handle is assuredly and tightly fixed to the vessel proper without using the above-mentioned bands and which has excellent appearance characteristics.

In accordance with the present invention, there is provided a synthetic resin vessel having a handle, which comprises a vessel proper comprising a neck, a barrel and a closed bottom, which are integrally prepared by blow-forming or draw-blow-forming of a synetic resin, a recess formed at a part of the barrel so that a deepest part of the recess has a diameter substantially equal or slightly larger than the diameter of the neck, a projection formed substantially at the center of the recess so that the section of the projection is non-circular, a circumferential concave groove formed around the projection, and a pair of short concave grooves extending from the top end and bottom end of the circumferential concave groove along the concave portion upwardly and downwardly, respectively, and a handle comprising an endless holding portion and an endless attachment portion, which are integrally prepared by injection molding of a synthetic resin, said handle being fixed by inserting the attachment portion into the circumferential concave groove and inserting the central part of the holding portion on the side end of the attachment portion into the short concave grooves.

In order to secure the handle more assuredly and tightly, it is preferred that the top end of the projection of the vessel proper be outwardly expanded in the form of a flange.

In order to prevent a washing liquid remaining in the projection at the step of washing the vessel and prevent a liquid from remaining in the projection while the liquid-filled vessel is used, it is preferred that a liquid-removing groove be formed in at least one of upper and lower parts in the projection.

In order to prevent deformation of the handle-attaching portion of the vessel and reinforce this portion, it is preferred that reinforcing ribs be formed on the concave side faces on both the sides of circumferential concave groove.

DETAILED DESCRIPTION OF THE INVENTION

Figure 1:
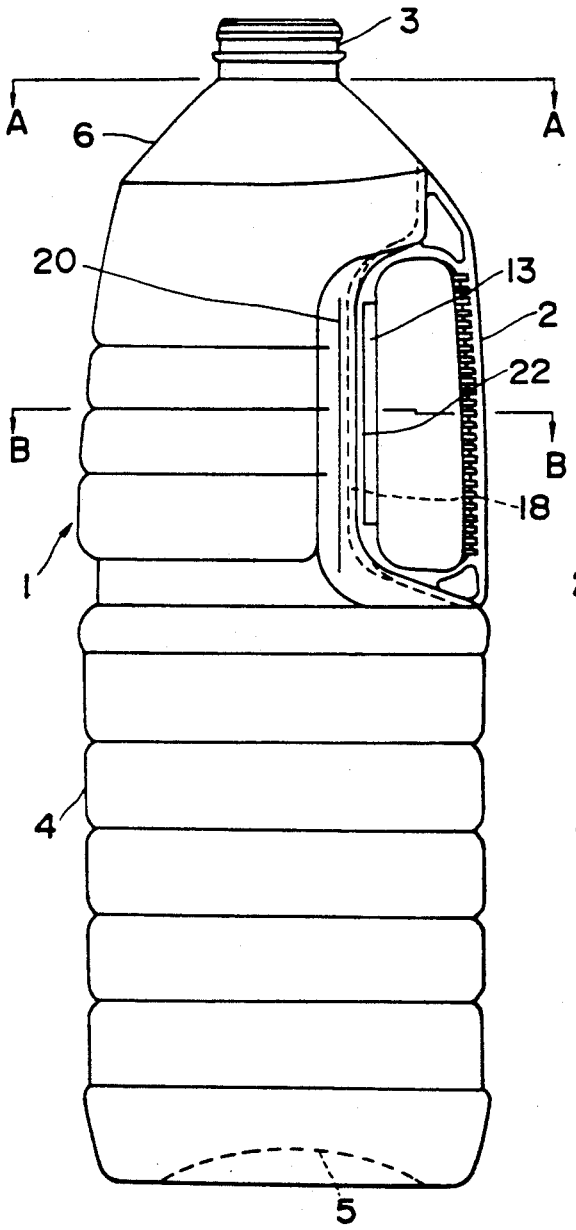
FIG. 1 is a side view of a synthetic resin vessel having a handle according to the present invention.

The vessel proper of the present invention corresponds to a conventional vessel proper in that the vessel proper comprises a neck, a barrel and a closed bottom, which are integrally prepared by blow-forming or draw-blow-forming of a synthetic resin. However, the vessel of the present invention is different from the conventional vessel in various points. The first characteristic feature of the vessel of the present invention is that a recess is formed at a part of the barrel so that the diameter of the deepest part of the recess has a diameter substantially equal to or slightly larger than the diameter of the neck, a projection having a non-circular section is formed substantially at the center of this recess, and a circumferential concave groove and a pair of short concave grooves extending from the top end and bottom end of the circumferential concave groove along the concave part upwardly and downwardly, respectively, are formed around the projection.

The handle used in the present invention corresponds to the handle of the conventional vessel in that the handle comprises a holding portion and an attachment portion to the vessel proper. However, the second characteristic feature of the vessel of the present invention is that both of the holding portion and attachment portion are endless, the handle is fixed to the vessel proper by inserting and embedding the attachment portion into the circumferential concave groove around the projection of the vessel proper and insering the central part of the holding portion on the side end of the attachment portion, and by expanding the top end of the projection outwardly in the form of a flange, the handle is secured to the vessel proper assuredly.

The third characteristic feature of the vessel of the present invention is that a liquid-removing groove is formed in at least one of the upper and lower parts in the projection, whereby liquid used for washing does not remain in the projection at the step of washing the vessel and liquid does not remain in the projection while the liquid-filled vessel is used, and the liquid is smoothly removed.

The fourth characteristic feature of the vessel of the present invention is that reinforcing ribs are formed on the concave side faces on both the sides of the circumferential concave groove formed around the projection, whereby deformation of the vessel by the stress imposed on the vessel through the handle is prevented and a reinforcing effect is attained.

According to the present invention, by the combination of these characteristic features, the following functional effects can be attained.

Namely, since a recess is formed on the barrel so that the diameter of the deepest part of the recess is substantially equal to or slightly larger than the diameter of the neck and a projection is formed substantially at the center of this recess, at blow-forming or draw-blow-forming of a preform, the thicknesses of the recess and projection are kept larger than those of other portions of the barrel wall because the recess and projection are located close to the preform wall. Furthermore, since a circumferential concave groove is formed around the projection and a pair of short concave grooves extending from the upper and lower ends of the circumferential groove upwardly and downwardly, respectively, are formed, there is produced a tough structure in which the handle-attaching projection and the recess supporting this projection are hardly deformed. The attachment portion of the handle is embedded and inserted into the circumferential concave groove around the projection and the central part of the holding portion on the side end of the attachment portion is inserted in the short concave grooves, and the projection is formed so that it has a non-circular section. Accordingly, collapse of the handle is prevented and the relative revolution between the handle and the vessel proper is controlled. Furthermore, since the top end of the projection is outwardly expanded in the form of a flange, collapse of the handle can be prevented and the handle can be secured assuredly. Especially, in the case where a concave face is formed on the top end face of the projection, since outward expansion of the flange can have a sufficient size assuredly, prevention of collapse of the handle and fixing of the handle can be accomplished more assuredly.

By forming a liquid-removing groove on at least one of the upper and lower parts in the projection, it is possible to prevent a small quantity of a washing liquid from remaining in the projection during washing of the vessel.

While filled vessel is being used, when the level of the contents becomes lower than the attachment portion of the handle, the contents tend to be left in the projection. However, if the above-mentioned liquid-removing groove is formed, the liquid is prevented from remaining in the projection, discoloration by the remaining content liquid is not caused and no unpleasant feeling arises. Moreover, the relative revolution between the handle and vessel proper is controlled by this liquid-removing groove.

Still further, since reinforcing ribs are formed on the concave side faces on both the sides of circumferential concave groove formed around the projection, when the handle is pulled toward a user or pushed forward, deformation of the vessel can be prevented. Especially, if reinforcing ribs capable of stretching in the vertical direction are disposed, the effect of preventing buckling can be attained.

Moreover, since each of the holding portion and attachment portion of the handle has an endless annular shape, a handle having a high strength can be formed with a relatively small amount of the resin, and the appearance of the vessel is not degraded by the handle and the commercial value of the vessel can be increased.

Since the attachment portion of the handle is located on the central side of the vessel, that is, at a position close to the center of gravity, even in the situation where the vessel is filled with liquid, the moment imposed on the attachment portion or holding portion is small when the handle is gripped, and therefore, the handle can be easily gripped with a small bearing force. Still further, since the holding portion of the handle is formed in the recess of the vessel and the handling portion has an endless annular shape, the hand can be easily inserted.

Furthermore, since the holding portion of the handle is located at substantially the same plane as the outermost face of the vessel barrel or located below this outermost face, the vessel can be compactly packed in a case, and there can be attained an advantage that storing and transporting space can be reduced.

The synthetic resin vessel having a handle according to the present invention will now be described in detail with reference to embodiments illustrated in the accompanying drawings.

Figure 2:
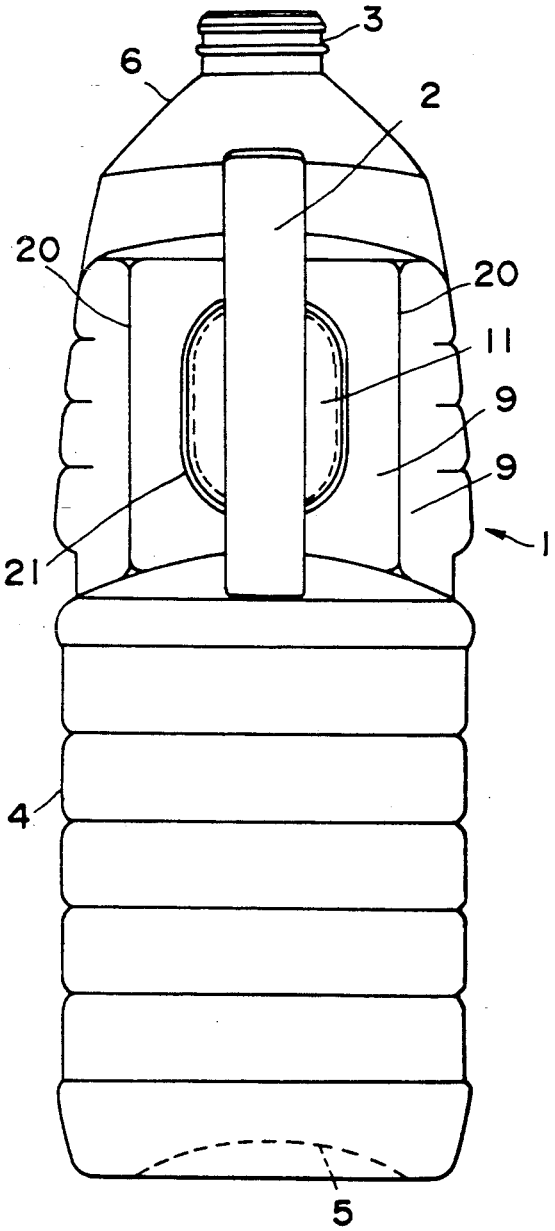
FIG. 2 is a side view illustrating the vessel of FIG. 1 rotated by 90°.
Figure 3:
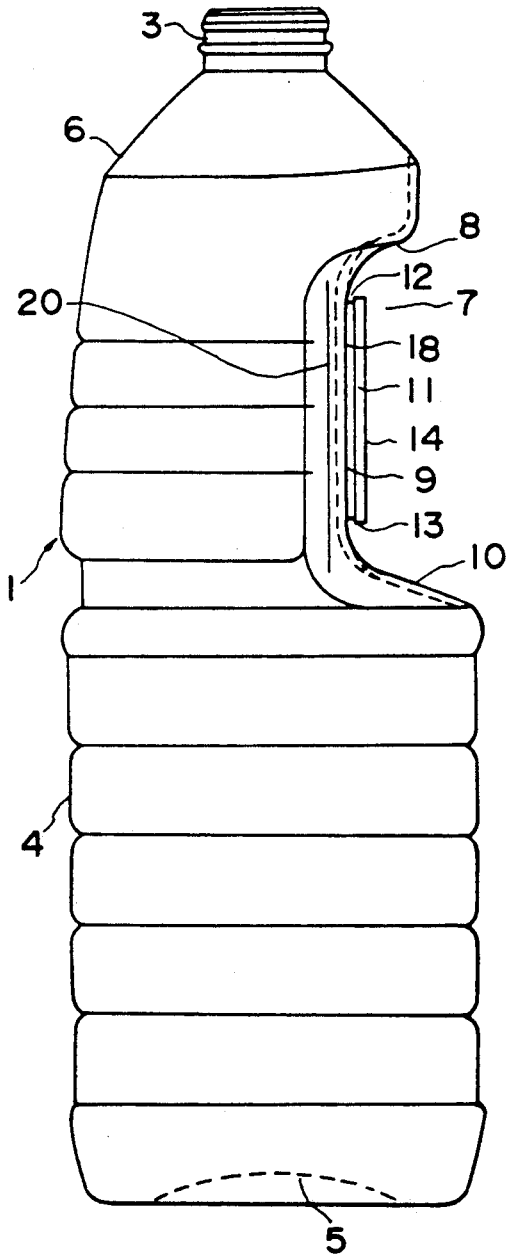
FIG. 3 is a side view illustrating only the vessel proper shown in FIG. 1.
Figure 4:
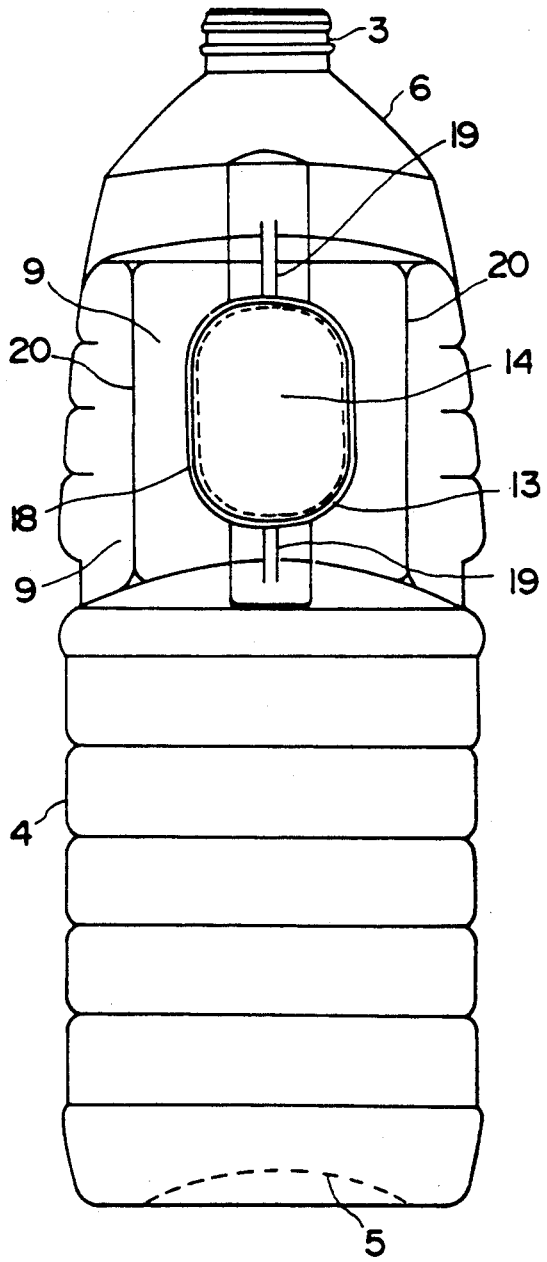
FIG. 4 is a side view illustrating the vessel proper of FIG. 3 rotated by 90°.
Figure 5:
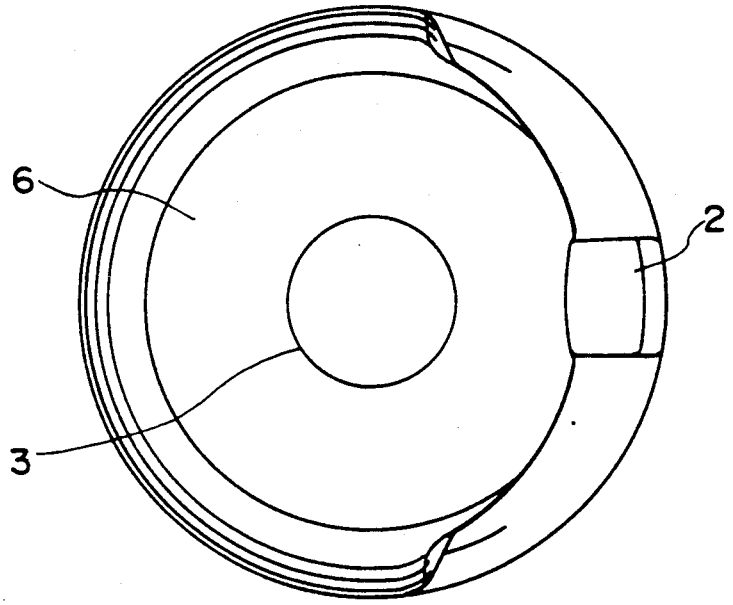
FIG. 5 is a view showing the section taken along line A—A in FIG. 1.
Figure 6:
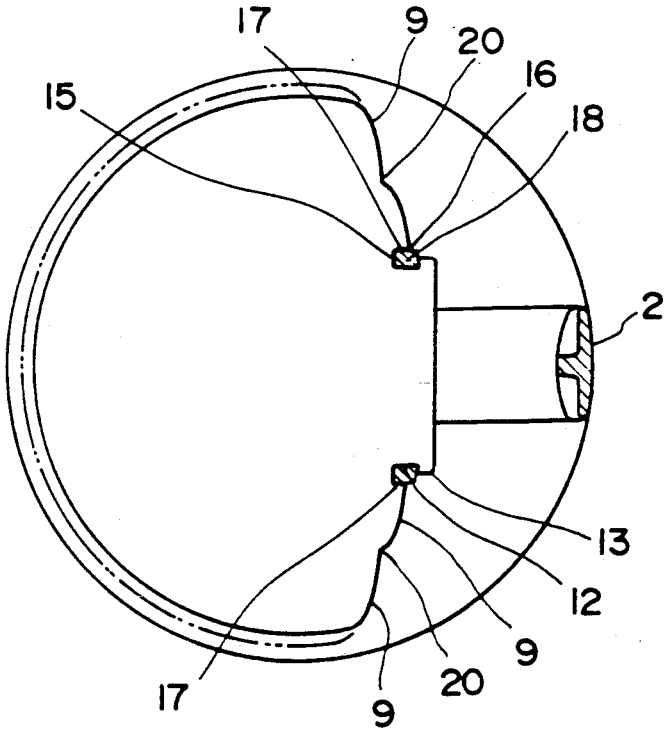
FIG. 6 is a view showing the section taken along line B—B in FIG. 1.
Figure 10:
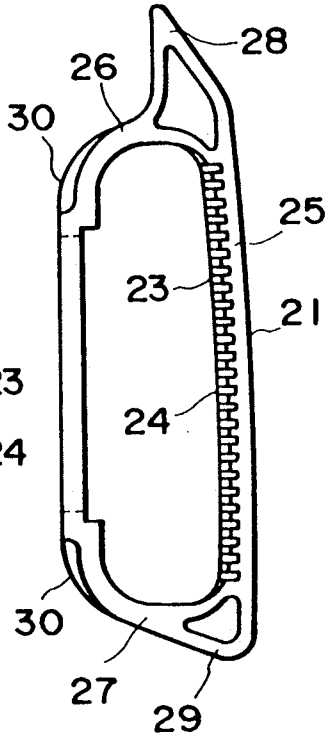
FIG. 10 is a side view illustrating the handle of FIG. 9 rotated by 90°.
Figure 9:
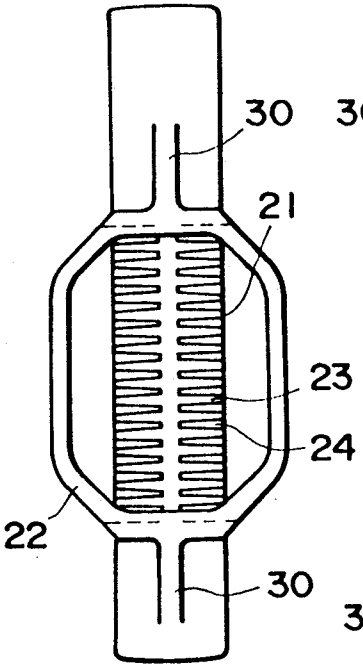
FIG. 9 is a side view illustrating another embodiment of the handle.
Figure 8:
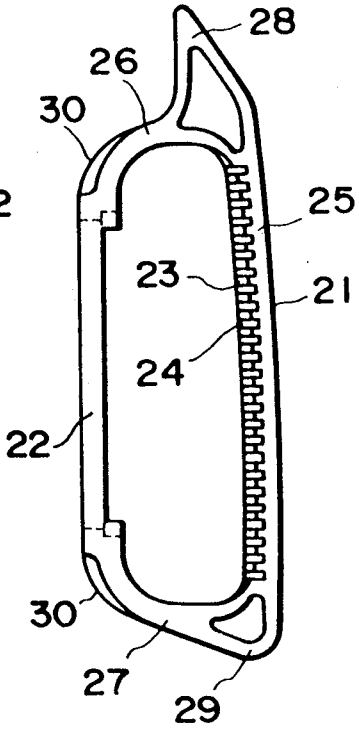
FIG. 8 is a side view showing of FIG. 7 rotated by 90°.
Figure 7:
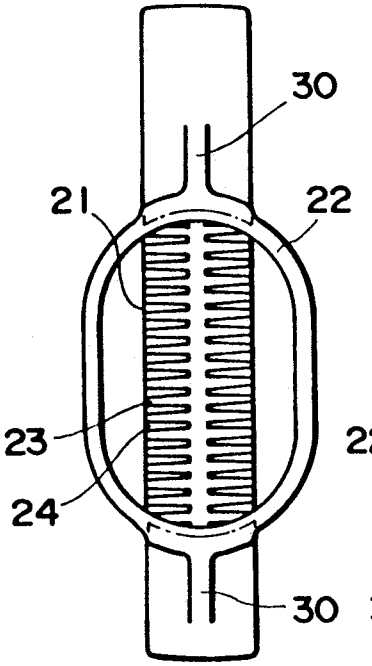
FIG. 7 is a side view illustrating only the handle shown in FIG. 1.

FIG. 1 is a side view illustrating one embodiment of the synthetic resin vessel having a handle according to the present invention, and FIG. 2 is a side view illustrating the vessel of FIG. 1 rotated by 90°. FIG. 3 is a side view illustrating a vessel proper of the vessel of FIG. 2, from which the handle is removed. FIG. 4 is a side view illustrating the vessel proper of FIG. 3 rotated by 90°. FIG. 5 is a view showing the section taken along line A—A in FIG. 1, and FIG. 6 is a side view illustrating the section taken along line B—B in FIG. 1. FIG. 7 is a side view illustrating only the handle of FIG. 1, and FIG. 8 is a side view illustrating the handle of FIG. 7 rotated by 90°. FIG. 9 is a side view illustrating another embodiment of the handle, and FIG. 10 is a side view illustrating the handle of FIG. 9 rotated by 90°.

Figure 11:
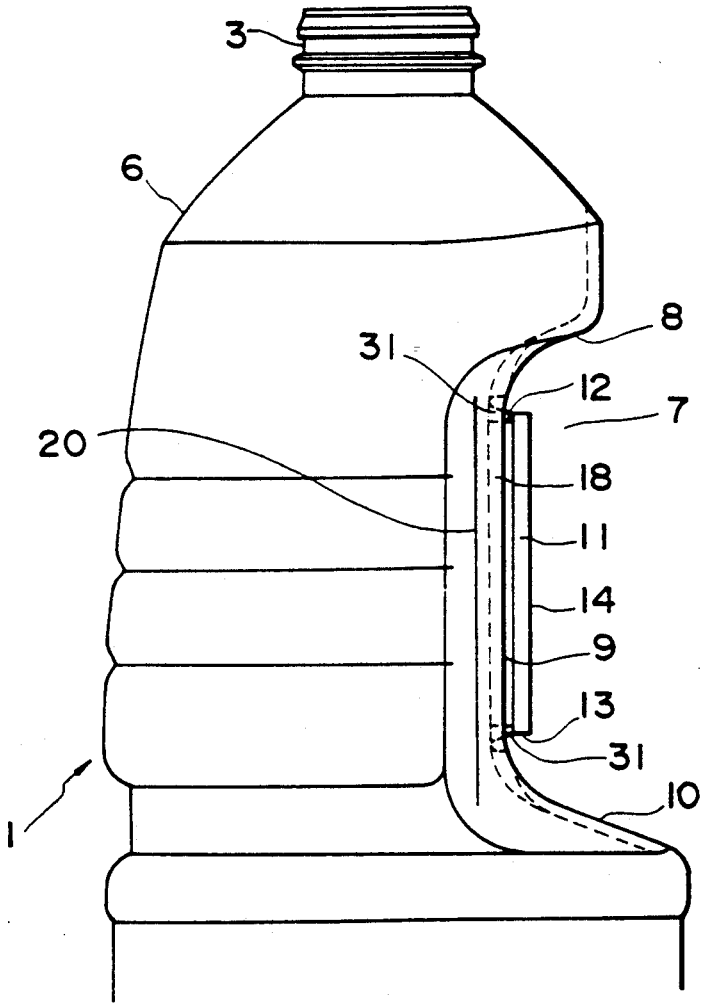
FIG. 11 is a side view illustrating a recess of a barrel and a surrounding portion in a vessel proper having liquid-removing grooves formed at upper and lower parts in the interior of a projection.
Figure 12:
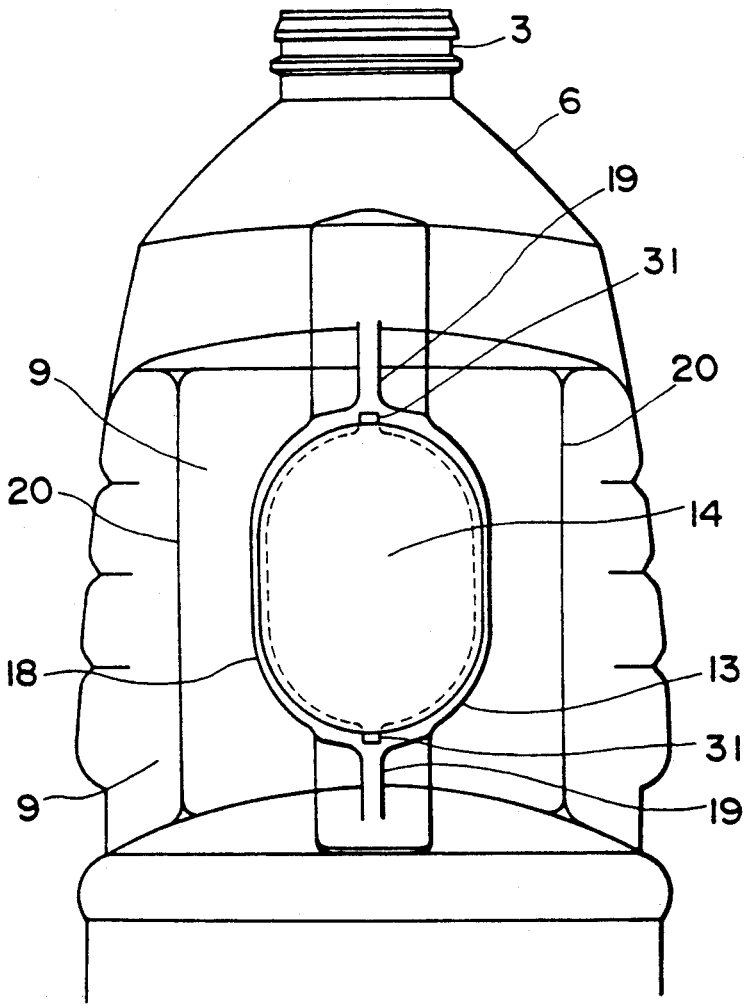
FIG. 12 is a side view illustrating the vessel proper of FIG. 11 rotated by 90°.

FIG. 11 is a side view illustrating the recess of the barrel and the surrounding portion in a vessel proper of the present invention in which liquid-removing grooves are formed at upper and lower parts in the projection, and FIG. 12 is a side view illustrating the vessel proper of FIG. 11 rotated by 90°.

Figure 13:
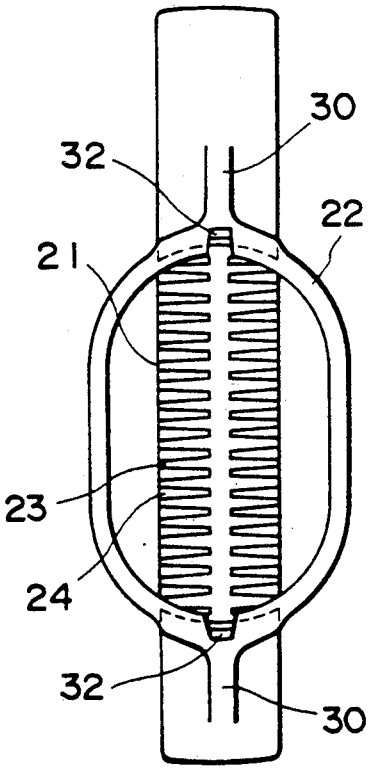
FIG. 13 is a side view illustrating the handle of FIG. 7 in which a concave groove is formed in an annular attachment portion of the handle.
Figure 14:
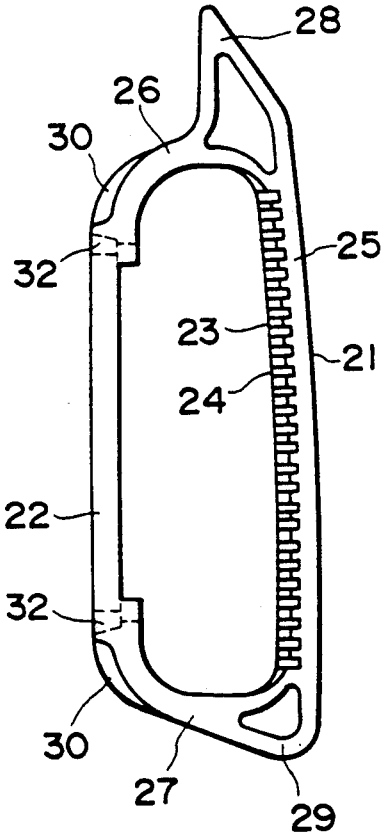
FIG. 14 is a side view illustrating the handle of FIG. 13 rotated by 90°.

FIG. 13 is a side view illustrating the handle of FIG. 7 in which concave grooves are formed at upper and lower parts of the annular attachment portion in correspondence to liquid-removing grooves formed at upper and lower parts in the projection of the vessel proper, and FIG. 14 is a side view illustrating the handle of FIG. 13 rotated by 90°.

Figure 15:
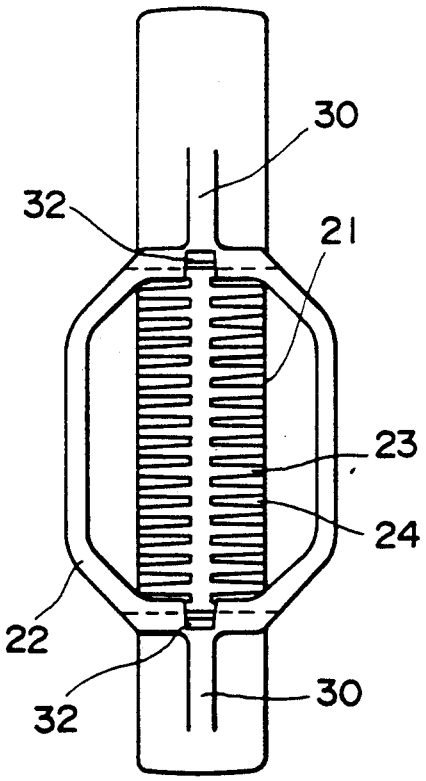
FIG. 15 is a side view illustrating the handle of FIG. 9 in which a concave groove is formed in an annular attachment portion of the handle.
Figure 16:
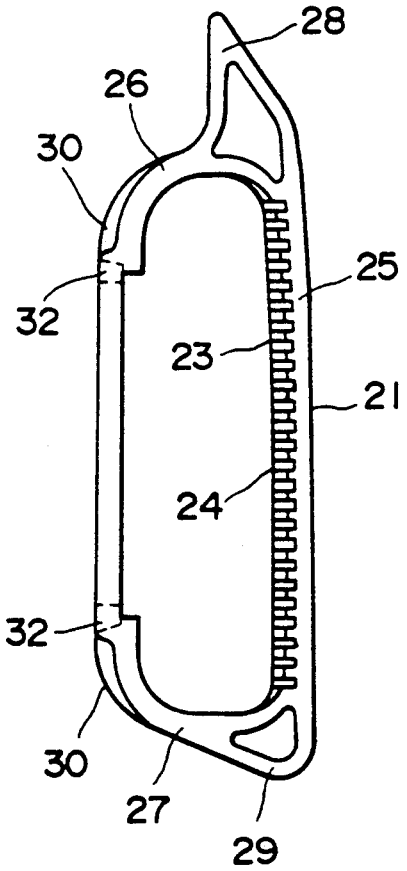
FIG. 16 is a side view illustrating the handle of FIG. 15 rotated by 90°.
Figure 17:
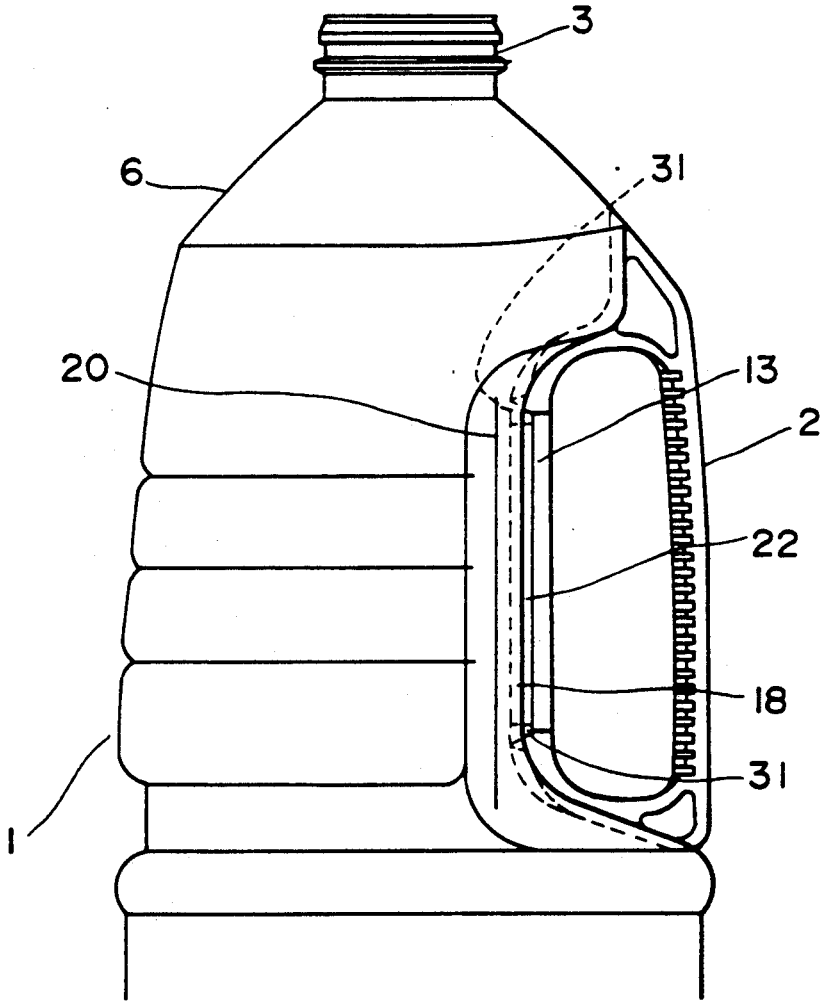
FIG. 17 is a side view illustrating a concave portion and a peripheral portion of a barrel in one embodiment of the synthetic vessel having a handle, in which liquid-removing grooves are formed at upper and lower parts in the interior of a projection.

FIG. 15 is a side view illustrating the handle of FIG. 9 in which concave grooves are formed at upper and lower parts of the annular attachment portion of the handle, and FIG. 16 is a side view illustrating the handle of FIG. 15 rotated by 90°. FIG. 17 is a side view illustrating the barrel, the recess and the surrounding portion in the synthetic resin vessel having a handle according to the present invention, which comprises the vessel proper of FIG. 11 having liquid-removing grooves at upper and lower parts in the projection and a handle having concave grooves formed at upper and lower parts of an annular attachment portion, which is attached to the vessel proper.

As shown in FIGS. 1 and 2, the synthetic resin vessel having a handle according to the present invention comprises a vessel proper indicated overall by reference numeral 1 and a handle represented overall by reference numeral 2.

Referring to FIGS. 3 through 6, the vessel proper 1 comprises a neck 3, a cylindrical barrel 4 and a closed bottom 5, and a conical shoulder 6 is present between the neck 3 and the barrel 4. A recess 7 is formed below this conical shoulder 6. This recess 7 comprises a top face 8 extending in a direction which is slightly slanted in relation to the center of the vessel when seen from the side face, a side face 9 extending substantially vertically and a bottom face 10 extending in a direction which is slightly slanted to the side face of the barrel. In the embodiment illustrated in the drawings, the recess 7 is formed at a position substantially intermediate between the conical shoulder 6 and the barrel 4 in the height direction. The side face 9 of the recess is formed with a substantially arcuate shape so that the deepest part of the recess has a diameter (the distance from the axis) substantially equal to or larger than the diameter of the neck 3, when seen in horizontal section.

A projection represented by reference numeral 11 is formed substantially at the center of this recess 7. The projection 11 is formed so that the vertical section thereof has a non-circular shape. In the embodiment shown in the drawings, the vertical section of the projection has an oval shape. However, the shape of the vertical section of the projection 11 is not particularly critical, so far as rotation of the handle is prevented where the projection 11 is combined with the handle described in detail hereinafter. For example, the vertical section of the projection 11 may have any of ellipsoidal, oblong, triangular, tetragonal, pentagonal and other polygonal shapes. This projection 11 is blow-formed or draw-blow-formed integrally with the recess 7 and other parts of the vessel proper, and the projection 11 comprises an outwardly extending small-space cylindrical portion 12, a flange portion 13 arranged at the top end of the cylindrical portion and having a size increasing in the transverse direction, and a top end face 14 closed at the flange portion. The projection 11 has a hollow structure. In this embodiment, the top end face 14 of the projection is concave so that a flange portion 13 expanding clearly and sufficiently in the transverse direction is formed at the time of formation of the projection 11.

A root face 15 of the projection 11 is formed at a position closer to the axis than a part 16 of the concave side face 9 having a smallest diameter (distance from the axis) through a step 17. Accordingly, it will be readily understood that a circumferential concave groove 18 is formed between the lower end of the cylindrical portion 12 of the projection 11 and the recess 7 for securing the handle more tightly. Short concave grooves 19 extend from the upper and lower ends of the circumferential concave groove 18 upwardly and downwardly, respectively, and the concave grooves 19, together with the circumferential concave groove 18, can secure the handle very tightly. One reinforcing rib 20 extending in the vertical direction (longitudinal direction) is formed on each of the concave side faces 9 on both sides of the circumferential concave groove 18. In the embodiment shown in the drawings, one rib is formed on each of the left and right sides in the longitudinal direction, but a plurality of ribs can be formed on each of both sides. Furthermore, one or a plurality of reinforcing ribs 20 in the circumferential direction (transverse direction) can be formed, though such ribs are not shown in the drawings. The reinforcing ribs 20 reinforce the vessel so that the vessel is not easily deformed by the stress imposed on the vessel through the handle when the handle is pulled toward a user or pushed forwardly or when the vessel is lifted by gripping the handle. Furthermore, the ribs 20 in the longitudinal direction exert an effect of preventing buckling of the vessel.

Referring to FIGS. 11 and 12, liquid-removing grooves 31 are formed at lower and upper parts in the projection 11 so that in washing the vessel, the washing liquid is does not remain in the projection 11 including a flange 13 on the top end of the cylindrical portion 12, or while the filled vessel is being used, even if the contents is decreased and the level of the contents becomes lower than the projection 11, the contents are prevented from remaining in the projection 11. The liquid-removing groove 31 is formed in the cylindrical portion 12 so that the groove extends from the centers of the upper and lower parts of the top end of the cylindrical portion 12 and transverses the centers of the upper and lower parts of the circumferential concave groove 18. In the embodiment shown in the drawings, the liquid-removing groove 31 is formed at the upper and lower parts in the projection 11. Of course, the liquid-removing groove 31 can be formed only at the upper or lower part projection 11. For example, in the where the liquid-removing groove 31 formed at the lower part, the dimensions of the liquid-removing groove are such that the lower width (bottom width) of the groove is about 1.5 to about 5 mm and the upper width of the groove is slightly larger than the lower width (bottom width). In order to remove the liquid smoothly (a pool of the liquid is not formed), the liquid-removing groove is inclined downwardly from the top end of the cylindrical portion 12 to the lower edge of the circumferential concave groove 18. Where the liquid-removing groove is formed at the upper part, the arrangement is substantially the same as the above arrangement adopted when the liquid-removing groove is formed at the lower part, if seen upside down.

Referring to FIGS. 7 and 8 showing the handle of the vessel of the present invention, this handle 2 comprises an endless grip portion 21 and an endless attachment portion 22, which are integrally prepared by injection forming of a synthetic resin. The grip portion 21 comprises a vertical portion 25 having nonskid convex parts 23 and concave parts 24 arranged alternately at small intervals, an upper curvature portion 26 and a lower curvature portion 27, and upper and lower corners 28 and 29 endlessly connected to the foregoing portions. The grip portion 21 is connected to an attachment portion 22 through these curvature portions 26 and 27 to construct a ring as shown in FIG. 7. As shown in FIG. 8, in the attachment portion 22, also a ring is formed in a plane substantially orthogonal to the plane including the attachment portion 22. The ring of the attachment portion 22 has a shape similar to that of the cylindrical portion 12 of the projection 11 of the vessel proper and an inner circumferential size substantially equal to the peripheral size of the cylindrical portion 12. This ring has such dimensions that the ring is embedded and inserted compactly in the circumferential concave groove 18 around the projection 11. Short convexities 30 are formed to extend from the centers of the upper and lower ends the attachment portion 22 to the upper and lower curvature portions 26 and 27 of the grip portion 21.

As shown in FIGS. 13 through 16, concave grooves 32 corresponding to the liquid-removing grooves 31 formed at the centers of the upper and lower parts in the projection 11 of the vessel proper are formed at the centers of the upper and lower parts of the annular attachment portion 22 of the handle. The liquid-removing groove 31 is embedded and inserted compactly in this concave groove 32. Thus, by forming these concave grooves 31, the annular attachment portion 22 of the handle can be embedded and inserted compactly in the circumferential concave groove 18 around the projection 11 of the vessel proper.

In the embodiment shown in the drawing, the concave groove 32 is formed at the upper and lower parts in the annular attachment portion 22 of the handle, but the concave groove 32 can be formed only at the upper or lower part according to the liquid-removing groove 31. The dimensions of this concave groove 32 correspond to those of the liquid-removing groove 31. For example, where the concave groove 32 is formed at the lower part of the annular attachment portion 22, the lower width (bottom width) of the groove is about 2 to about 6 mm and the upper width of the groove is slightly larger than the lower width (bottom width). The concave groove 32 transverses the center of the lower part of the annular attachment portion 12 and is inclined downwardly toward the center of the vessel proper. Where the groove 32 is formed at the upper part, the arrangement is substantially the same as the arrangement adopted when the groove 32 is formed at the lower part, if seen upside down.

Referring to FIG. 1 illustrating the situation where the vessel proper 1 is combined with the handle 2, the annular attachment portion 22 is embedded and inserted in the circumferential concave groove 18 around the projection 11 of the vessel proper 1, and the short convexity 30 contiguous to the annular attachment portion 22 is inserted into the short concave groove 19 extending from the upper and lower ends of the circumferential concave groove 18 and the top end of the projection 11 is expanded to form an engaging flange 13, whereby the handle 2 is secured to the vessel proper 1. Furthermore, since the projection 11, circumferential concave groove 18 and attachment portion 22 are formed as a non-circular section and the convexity 30 is inserted into the short concave groove 19, the relative revolution between the vessel proper and the handle can be effectively prevented.

FIGS. 9 and 10 show an octagonal ring of the attachment portion 22 of the handle, which is different from the annular shape shown in FIGS. 7 and 8. Of course, the sectional shape of the projection and the shapes of the circumferential concave groove and the like are adjusted according to the octagonal ring of the attachment portion.

The liquid-removing groove 31 formed at the upper and lower parts in the projection 11 of the vessel proper shown in FIGS. 11 and 12, is embedded and inserted compactly in the concave groove 32 formed at the upper and lower parts of the annular attachment portion 22 of the handle, as shown in FIGS. 13 through 16.

The synthetic resin vessel having a handle is prepared, for example, using a process in which a handle is prepared in advance by injection forming, this handle is inserted into a blow mold and a preform for a vessel proper is prepared in the blow mold by blow forming or draw blow forming (insert blow forming process), or a process in which a preform for a vessel proper is subjected in a blow mold to blow forming or draw blow forming in advance to prepare a vessel proper, the vessel proper is inserted into an injection mold and a resin for a handle is subjected to injection forming (insert injection forming process).

The following materials can be used for the preparation of a synthetic resin vessel having a handle according to the present invention.

Blow-formable resins, especially thermoplastic resins molecularly orientable by drawing, can be optionally used as the resin constituting the vessel proper. For example, examples include thermoplastic polyesters such as polyethylene terephthalate (PET) and polybutylene terephthalate, polycarbonates, acrylic monomer/butadiene/styrene copolymers (ABS resins), polyacetal resins, nylons such as nylon 6, nylon 6,6 and copolymer nylons thereof, acrylic resins such as polymethyl methacrylate, isotactic polypropylene, and polystyrene. The handle-forming resin may be the same as or different from the resin for the vessel proper. Examples of resins other than those exemplified above, are low-density polyethylene, medium-density polyethylene, high-density polyethylene, an ethylene/propylene copolymer, an ethylene/butene-1 copolymer and a styrene/butadiene thermoplastic elastomer. Of course, various additives such as a colorant and a filler can be incorporated into the handle-forming resin.

EXAMPLE 1

Figure 18:
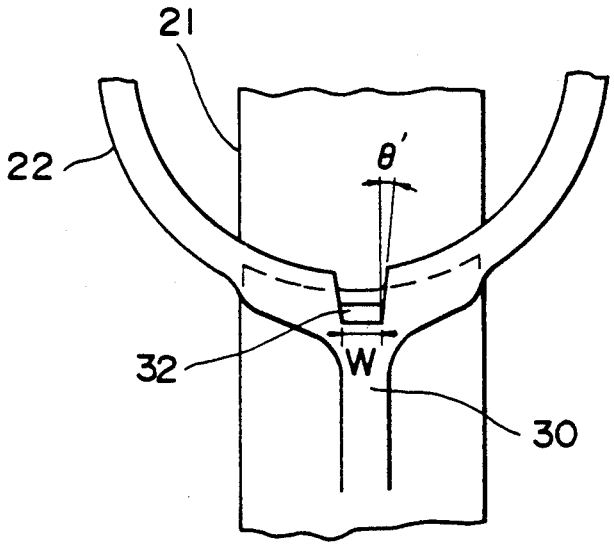
FIGS. 18 and 19 are enlarged partial views showing the lower part of annular attachment portions of the handle shown in FIGS. 13 and 14, respectively.
Figure 19:
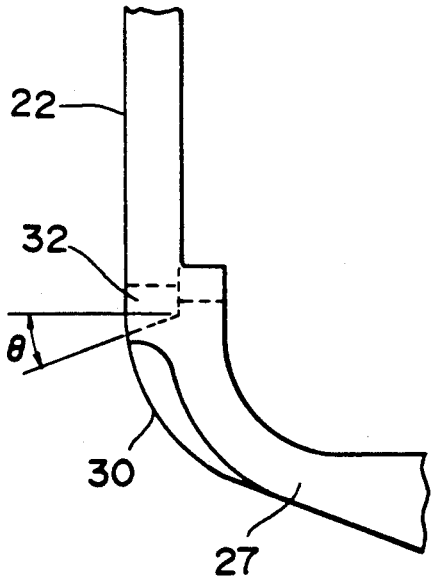

FIGS. 18 and 19 are enlarged views showing the lower part of the annular attachment portion of the handle in FIGS. 13 and 14. Referring to FIG. 18, the angle formed between the vertical line passing through the end of the lower width (bottom width) of the concave groove 32 and the line connecting the end of the upper width and the end of the lower width is designated as $\theta'°$, the length of the lower width is designated as W mm, and referring to FIG. 19, the angle of downward inclination of the concave groove 32 from the horizontal plane is designated in degrees.

A handle (composed of polypropylene) having a shape as shown in FIGS. 13 and 14 and having the concave groove 32 formed only at the lower part of the annular attachment portion is prepared by injection forming, this handle is inserted into a blow mold and blow forming of a preform (composed of PET) for the vessel proper is carried out in this blow mold to prepare a synthetic resin vessel (having a capacity of 1.8 l) having a handle, which has a shape as shown in FIGS. 1 and 2 and the liquid-removing groove 31 at the lower part in the projection 11.

Soy sauce is filled in the vessel to the level of the lower part of the vessel, and the vessel is reversed and liquid remaining in the projection 11 is examined. It is confirmed that no liquid pool is formed. Soy sauce is filled in the vessel every day and used for about one month, but no liquid pool is formed and the appearance of the vessel remains good.

For comparison, soy sauce is similarly filled in a synthetic resin vessel having a handle, which has a shape as shown in FIGS. 1 and 2 and in which the liquid-removing groove 31 is not formed in the projection 11 of the vessel proper (namely, the concave groove 32 is not formed in the annular attachment portion of the handle). When the vessel is reversed and examined, a small liquid pool (slight discoloration) is found in the projection. When the filled vessel is used repeatedly for about 1 month, discoloration becomes conspicuous as a result as concentration of the liquid pool.

The present invention is characterized in that a recess is formed at a part of the barrel of the vessel proper so that the diameter of the deepest part of the recess is substantially equal to or slightly larger than that of the neck, and a projection having a non-circular section is formed substantially at the center of this recess; a circumferential concave groove is formed around the projection; a pair of short concave grooves extending from the upper and lower ends of the circumferential concave groove upwardly and downwardly, respectively, are formed; the holding portion and attachment portion of the handle are formed so that they are endless and the attachment portion has an annular shape similar to that of the projection; and the attachment portion is inserted into the circumferential groove, the central part of the holding portion on the side end of the attachment portion is inserted in the short concave groove, and the top end of the projection is expanded outwardly to form a flange. According to the present invention, the following effects can be attained by the combination of these characteristic features.

Namely, since a recess is formed on the barrel so that the diameter of the deepest part of the recess is substantially equal to or slightly larger than the diameter of the neck and a projection is formed substantially at the center of this recess, at blow-forming or draw-blow-forming of a parison, the thicknesses of the recess and projection are kept larger than those of other portions of the barrel wall because the recess and projection are located close to the parison wall. Furthermore, since a circumferential concave groove is formed around the projection and a pair of short concave grooves extending from the upper and lower ends of the circumferential groove upwardly and downwardly, respectively, are formed, a tough structure is produced in which the handle-attaching projection and the recess supporting this projection are hardly deformed. The attachment portion of the handle is embedded and inserted into the circumferential concave groove around the projection and inserted in the short concave grooves, and the projection is formed so that is has a non-circular section. Accordingly, collapse of the handle is prevented and the relative revolution between the handle and the vessel proper is controlled. Furthermore, since the top end of the projection is outwardly expanded in the form of a flange, collapse of the handle can be prevented and the handle can be secured assuredly. Especially, where a concave face is formed on the top end face of the projection, since outward expansion of the flange can have a sufficient size prevention of collapse of the handle and fixing of the handle can be accomplished more assuredly.

By forming a liquid-removing groove on at least one of the upper and lower parts in the projection, it is made possible to prevent washing liquid from remaining in the projection at the step of washing the vessel. While a filled vessel is being used, liquid is prevented from remaining in the projection, discoloration by the remaining liquid is not caused and no unpleasant feeling arises. Moreover, relative revolution between the handle vessel proper is controlled by this liquid-removing groove.

Still further, since reinforcing ribs are formed on the concave side faces on both the sides of the circumferential concave groove formed around the projection, deformation of the vessel can be prevented against the stress imposed on the vessel through the handle. Especially, if reinforcing ribs capable of stretching in the vertical direction are disposed, the effect of preventing buckling can be attained.

Moreover, since each of the holding portion and attachment portion of the handle has an endless annular shape, a handle having a high strength can be formed with a relatively small amount of the resin, and the appearance of the vessel is not degraded by the handle and the commercial value of the vessel can be increased.

Since the attachment portion of the handle is located on the central side of the vessel, that is, at a position close to the center of gravity, even where the vessel is filled with liquid, the moment imposed on the attachment portion or holding portion is small when the handle is gripped, and therefore, the handle can be easily gripped with a small bearing force. Still further, since the holding portion of the handle is formed in the recess of the vessel and the handle portion has an endless annular shape, the hand can be easily inserted.

Furthermore, since the holding portion of the handle is located at substantially the same plane as the outermost face of the vessel barrel or located below this outermost face, the vessel can be compactly packed in a case, and there can be attained an advantage that storing and transporting space can be reduced.

We claim:

1. A synthetic resin vessel having a handle, which comprises a vessel proper comprising a neck, a barrel and a closed bottom, which are integrally prepared by blow-forming or draw-blow-forming of a synthetic resin, a recess formed at a part of the barrel so that a deepest part of the recess has a diameter substantially equal to or slightly larger than the diameter of the neck, a projection formed substantially at the center of the recess so that the peripheral configuration of the projection is non-circular, a circumferential outwardly concave groove formed around the projection, and a pair of short outwardly concave grooves extending from the top end and bottom end of the circumferential concave groove along the concave portion upwardly and downwardly, respectively, and a handle comprising a holding portion, with upper and lower ends joined to an annular attachment portion dimensioned to be secured about said circumferential groove, which are integrally prepared by injection molding of a synthetic resin, said handle, including fixing means at the upper and lower ends adjacent the attachment portion, being fixed by inserting the attachment portion into the circumferential concave groove and inserting the fixing means of the holding portion into the short concave grooves.

2. A synthetic resin vessel having a handle according to claim 1, wherein the top end of the projection of the vessel proper to which the handle is attached is outwardly expanded to form a flange.

3. A synthetic resin vessel having a handle according to claim 2, wherein an inwardly concave liquid-removing groove is formed in at least one of the upper and lower parts in the projection.

4. A synthetic resin vessel having a handle according to claim 1 or 2, including reinforcing ribs formed on concave side faces on both sides of the circumferential concave groove.

* * * * *